US006650041B1

(12) United States Patent
Speer et al.

(10) Patent No.: US 6,650,041 B1
(45) Date of Patent: Nov. 18, 2003

(54) FLUORESCENT LAMP AND AMALGAM ASSEMBLY THEREFOR

(75) Inventors: Richard S. Speer, Concord, MA (US); Joseph E. Lester, Lincoln, MA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 10/225,718

(22) Filed: Aug. 22, 2002

(51) Int. Cl.[7] ..... H01J 1/62

(52) U.S. Cl. ..... 313/490; 313/492; 313/493; 313/483

(58) Field of Search ..... 313/490, 493, 313/492, 483

(56) References Cited

U.S. PATENT DOCUMENTS

| | | | | |
|---|---|---|---|---|
| 4,035,682 A | | 7/1977 | Bubar | 313/174 |
| 4,393,325 A | | 7/1983 | van der Kooi | 313/552 |
| 4,528,209 A | | 7/1985 | Anderson et al. | 427/67 |
| 5,434,482 A | | 7/1995 | Borowiec et al. | 315/248 |
| 5,629,584 A | | 5/1997 | Borowiec et al. | 315/565 |
| 5,767,617 A | | 6/1998 | Wharmby et al. | 313/489 |
| 5,783,912 A | * | 7/1998 | Cocoma et al. | 315/248 |
| 5,796,208 A | * | 8/1998 | Girach | 313/493 |
| 5,808,414 A | * | 9/1998 | Wharmby et al. | 313/607 |
| 5,994,837 A | | 11/1999 | Willems et al. | 313/550 |
| 6,097,137 A | | 8/2000 | Forsdyke et al. | 313/161 |

* cited by examiner

*Primary Examiner*—Robert H. Kim
*Assistant Examiner*—Elizabeth Gemmell
(74) *Attorney, Agent, or Firm*—Carlo Bessone

(57) ABSTRACT

An amalgam assembly for a fluorescent lamp includes a glass exhaust tubulation extending toward a base portion of the lamp, the tubulation being closed at an end thereof adjacent the lamp base portion, and a retaining structure disposed in the tubulation and retained by a pinched portion of the tubulation. A mercury amalgam body is disposed in the tubulation between the retaining structure and the tubulation closed end. The amalgam body includes lithium for wetting internal surfaces of the glass tubulation to cause the amalgam to adhere to the tubulation internal surfaces when the amalgam body is liquidized, and to thereby prevent the amalgam from flowing past the retaining structure and into the lamp envelope.

18 Claims, 2 Drawing Sheets

FLUORESCENT LAMP AND AMALGAM ASSEMBLY THEREFOR

BACKGROUND OF THE INVENTION

1. Field of the Invention

This invention relates to fluorescent lamps and is directed more particularly to an amalgam assembly including an improved amalgam for use within an exhaust tubulation of a fluorescent lamp, and to a fluorescent lamp including the amalgam assembly.

2. Description of the Prior Art

The light output of fluorescent lamps is critically dependent upon mercury vapor pressure (vapor density) within the lamp envelope. The mercury vapor pressure, in turn, is controlled by the temperature of excess liquid mercury which condenses in the coldest part of the lamp envelope, the so-called "cold spot". Fluorescent lamps typically include at least one tubulation that has an opening into the interior of the lamp envelope and which, in construction of the lamp, is used as an exhaust and fill tubulation. At completion of manufacture, the exhaust tubulation is hermetically tipped off and the tipped end typically becomes the lamp "cold spot".

The amalgam is commonly located in the exhaust tubulation cold spot. Such amalgams reduce the mercury vapor pressure relative to that of pure mercury at any given temperature and thereby permit optimum light output at elevated temperatures. Such amalgams also provide a broadened peak in the light output versus temperature curve, so that near optimum light output is obtained over an extended range of ambient temperatures.

When lamps are operated at temperatures lower or higher than the optimum ambient temperature, light output decreases by as much as 30% or more relative to peak value. This is a common occurrence when lamps are operated in enclosed or semi-enclosed fixtures. In addition to reduced light output, the color of the light varies as a result of the varying contribution of blue spectral emission from the mercury vapor in the discharge.

The problem of mercury vapor pressure control under varying temperature conditions is solved, at least in part, through the use of various alloys capable of absorbing mercury from its gaseous phase. Alloys of low temperature melting metals are often placed within fluorescent lamps to amalgamate with the excess mercury, and to regulate the mercury vapor pressure within the lamp. Alloys known to be particularly useful in forming amalgams with mercury include a lead-bismuth-tin alloy, a bismuth-indium alloy, a bismuth and tin alloy, and a zinc, indium and tin alloy. Other useful amalgams may be formed with pure indium, pure lead, and pure zinc.

The lamp typically is provided with an excess amount of mercury amalgam, that is, more amalgam than is needed to supply the mercury vaporized when the lamp reaches a stabilized operating condition. As the lamp ages, some of the excess amalgam is required to replace the mercury chemically bound elsewhere in the lamp during the life of the lamp.

When an amalgam fluorescent lamp is turned off, the amalgam cools and the mercury vapor within the lamp is gradually absorbed into the amalgam. When the lamp is turned on, the lumen output is significantly reduced until the amalgam is warmed up to a point at which the amalgam emits sufficient mercury vapor to permit efficient lamp operation.

In some types of lamps, particularly electrodeless fluorescent lamps, it is important that the amalgam be prevented from settling within the arc environment in the lamp envelope where the amalgam can cause deleterious changes in the lumen output and the lumen-temperature performance of the lamp.

In base-up lamps, there has been a particular problem in that, in use, the sealed end of the tubulation is pointed upwardly and the end of the tubulation that opens into the lamp envelope is disposed downwardly of the amalgam, and the amalgam has tended to drop by gravity downwardly into the lamp envelope, where a much higher temperature is present, causing a sudden rise in mercury vapor pressure and an increase in lamp voltage, resulting in the occurrence of black spots on the glass envelope. If the lamp voltage exceeds the maximum sustaining voltage of the ballast provided in the lamp, the lamp extinguishes. There is thus required a means for retaining liquid amalgam in the tubulation, but permitting mercury vapor to exit the tubulation and flow into the lamp envelope.

Accordingly, there is a need for an amalgam assembly including an improved amalgam and/or an improved amalgam retention means, for limiting the amalgam to the tubulation sealed end region. There is further a need for a fluorescent lamp provided with such an amalgam assembly and/or amalgam retention means.

SUMMARY OF THE INVENTION

An object of the invention is, therefore, to provide an amalgam assembly featuring an improved amalgam for disposition in an exhaust tubulation of a fluorescent lamp to prevent migration of liquid amalgam into the lamp envelope.

A further object of the invention is to provide an amalgam assembly featuring an improved tubulation in which to dispose an amalgam body, the improved tubulation preventing migration of liquid amalgam into the lamp envelope.

A still further object of the invention is to provide an electrodeless fluorescent lamp having therein an amalgam assembly featuring an improved amalgam and/or an improved amalgam retention means in the exhaust tubulation.

With the above and other objects in view, as will hereinafter appear, a feature of the present invention is the provision of an amalgam assembly for a fluorescent lamp. The assembly comprises a glass exhaust tubulation extending toward a base portion of the lamp, the tubulation being closed at an end thereof adjacent the lamp base portion, and a retaining structure disposed in the tubulation and retained by a pinched portion of the tubulation.

A mercury amalgam body is disposed in the tubulation between the retaining structure and the tubulation closed end, the amalgam body including lithium for wetting internal surfaces of the glass tubulation to cause the amalgam to adhere to tubulation internal surfaces when the amalgam body is liquidized, and to thereby prevent the amalgam body from flowing past the retaining structure and into the lamp envelope.

In accordance with a further feature of the invention, there is provided an amalgam assembly for a fluorescent lamp. The assembly comprises a glass exhaust tubulation extending toward a base portion of the lamp, the tubulation being closed at an end thereof adjacent the lamp base portion, and a layer of metal containing lithium adhered to an inside surface of the exhaust tubulation. A mercury amalgam body is disposed in the tubulation between the tubulation closed end and a pinched portion of the tubulation. Upon liquidizing of the amalgam body, the liquid amalgam adheres to the layer, to thereby prevent the amalgam from flowing past the tubulation pinched portion and into the lamp envelope.

In accordance with a still further feature of the invention, there is provided an electrodeless fluorescent lamp assembly comprising a light-transmissive envelope containing an ionizable, gaseous fill for sustaining an arc discharge when subjected to a radio frequency magnetic field and for emitting ultraviolet radiation as a result thereof, the envelope having an interior phosphor coating for emitting visible radiation when excited by the ultraviolet radiation, and the envelope having a re-entrant cavity formed therein. An excitation coil is contained within the re-entrant cavity for providing the radio frequency magnetic field when excited by a radio frequency power supply. A glass exhaust tubulation extends through the re-entrant cavity and into the envelope, the exhaust tubulation having a closed end proximate a base portion of the lamp. A pinched configuration is formed in the exhaust tubulation at a predetermined distance from the tubulation closed end, and a retaining structure is disposed in the tubulation and retained by the pinched configuration. A mercury amalgam body is disposed in the tubulation between the retaining structure and tubulation closed end, the amalgam body including lithium for wetting internal surfaces of the glass tubulation touched by the amalgam to cause the amalgam to adhere to the tubulation internal surfaces when the amalgam body is liquidized and to thereby prevent the amalgam body from flowing past the retaining structure and into the lamp envelope.

In accordance with still another feature of the invention, there is provided an electrodeless fluorescent lamp assembly comprising a light-transmissive envelope containing an ionizable, gaseous fill for sustaining an arc discharge when subjected to a radio frequency magnetic field and for emitting ultraviolet radiation as a result thereof, the envelope having an interior phosphor coating for emitting visible radiation when excited by the ultraviolet radiation, and the envelope having a re-entrant cavity formed therein. An excitation coil is contained within the re-entrant cavity for providing the radio frequency magnetic field when excited by a radio frequency power supply. A glass exhaust tubulation extends through the re-entrant cavity and into the envelope, the exhaust tubulation having a closed end proximate a base portion of the lamp. A pinched configuration is formed in the exhaust tubulation at a predetermined distance from the tubulation closed end, and a retaining structure is disposed in the tubulation and retained by the pinched configuration. A mercury amalgam body is disposed in the tubulation between the retaining structure and tubulation closed end, and a layer of metal containing lithium is adhered to an inside surface of the exhaust tubulation, wherein upon liquidizing of the amalgam body, the liquid amalgam adheres to the layer, to thereby prevent the amalgam from flowing past the retaining structure and into the lamp envelope.

The above and other features of the invention, including various novel details of construction and combinations of parts, will now be more particularly described with reference to the accompanying drawings and pointed out in the claims. It will be understood that the particular devices embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent.

In the drawings.

DESCRIPTION OF THE PREFERRED EMBODIMENT

Figure 1:
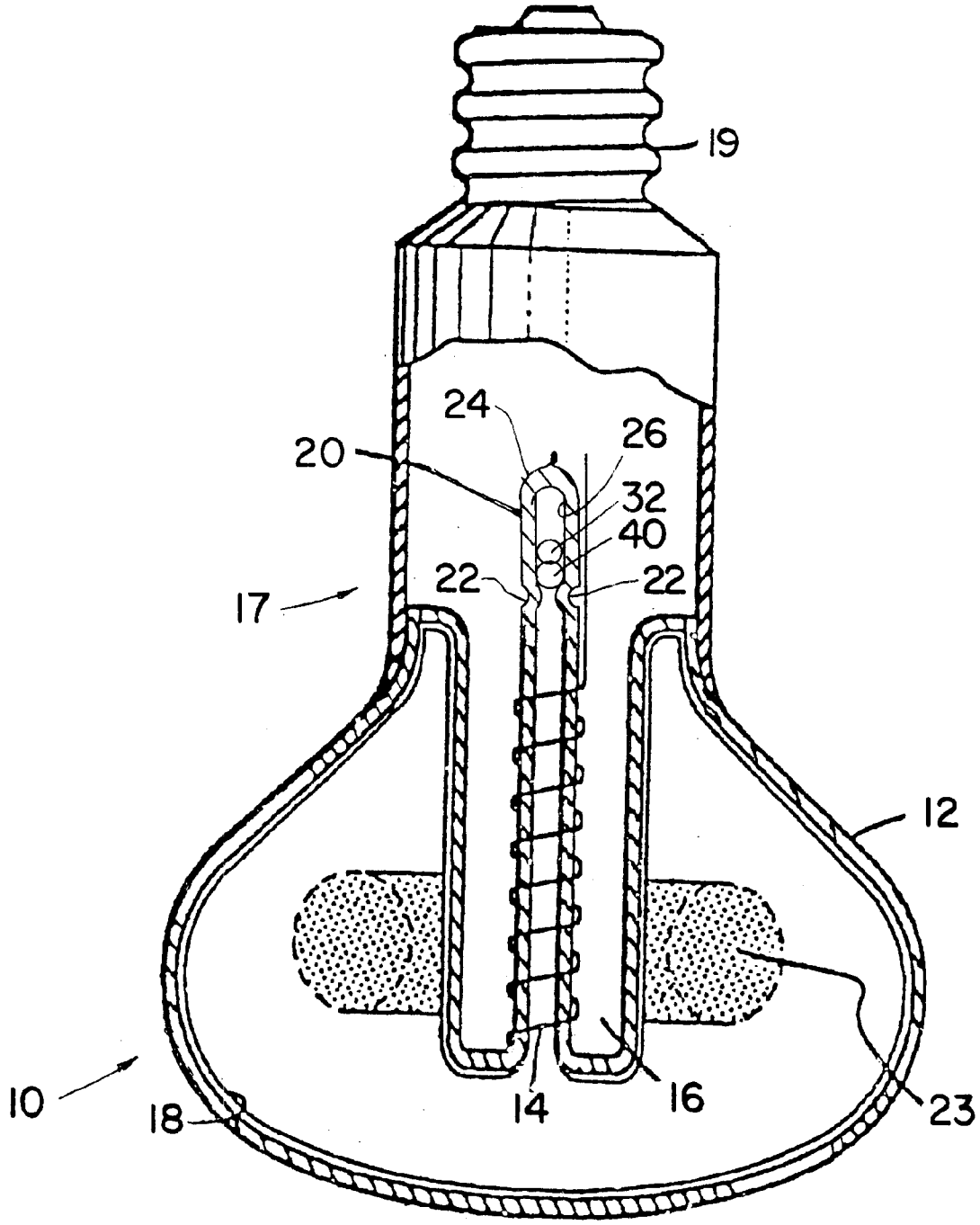
FIG. 1 PRIOR ART
FIG. 1 is an elevational broken-away and partly sectional view of a prior art electrodeless fluorescent lamp.

Referring to FIG. 1, it will be seen that a known base-up compact fluorescent lamp 10 is provided with a light-transmissive envelope 12 containing an ionizable gaseous fill for sustaining an arc discharge. In manufacture, the lamp 10 is dosed with the fill via an exhaust tubulation 20 in well-known manner. A suitable fill, for example, comprises a mixture of a rare gas (e.g., krypton and/or argon) and mercury vapor. An excitation coil 14 is situated within, and removable from, a re-entrant cavity 16 within the envelope 12. For purposes of illustration, the coil 14 is shown schematically as being wound about the exhaust tubulation 20. However, the coil 14 may be spaced apart from the exhaust tubulation 20 and wound about a core of insulating material (not shown), or may be free standing (not shown), as desired. The interior surfaces of the envelope 12 are coated in well-known manner with a suitable phosphor 18. The envelope 12 fits into one end of a base assembly 17 containing a radio frequency power supply (not shown) with a standard (e.g., Edison type) lamp base 19.

A mercury amalgam body 32 is placed and retained in a location optimized for the particular amalgam in a particular lamp. Each amalgam has its own optimum range of operating temperatures to provide a suitable mercury vapor pressure.

An indentation, or dimple, 22 is situated toward a tip-off region of the exhaust tubulation 20. The tip-off region is the area at the top of the exhaust tubulation which is sealed, or "tipped off" to form the closed end 24 of the exhaust tubulation after evacuating and filling the lamp therethrough.

After the lamp is evacuated and filled through the exhaust tubulation 20, an appropriately sized and shaped dose locating member, preferably comprising a glass ball 30, is inserted into the exhaust tubulation 20 through the opening at the tip-off region. By virtue of the presence of the dimple 22 and the size and shape of glass ball 30, the dose locating member remains on the side of the dimple away from the re-entrant cavity 16. The amalgam 32 is then inserted into the exhaust tubulation 20 through the opening in the tip-off region. The combination of dimple 22 and glass ball 30 results in placement and retention of the amalgam 32 at a predetermined location. As noted above, the exhaust tubulation is tipped-off above the amalgam 32 to provide the tubulation closed end 24.

In operation, current flows in the coil 14 as a result of excitation by the radio frequency power supply. A radio frequency magnetic field is thereby established within the envelope 12 which ionizes and excites the gaseous fill contained therein, resulting in a toroidal discharge 23 and emitting ultraviolet radiation therefrom. The phosphor 18 absorbs the ultraviolet radiation and emits visible radiation.

Figure 2:
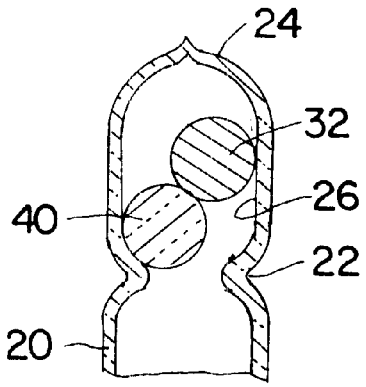
FIG. 2 is a diagrammatic sectional illustration of an improved amalgam assembly for preventing movement of liquid amalgam into a lamp of the type shown in FIG. 1 from the preferred amalgam location.

Referring to FIG. 2, it will be seen that in accordance with the present invention there is provided an amalgam retaining structure comprising one or more glass balls 40 disposed in the glass tubulation 20 and retained by at least one pinched portion 22 of the tubulation. The mercury amalgam body 32 is disposed between the glass balls 40 and the exhaust tubulation closed end 24, as shown in FIG. 2.

The amalgam body 32 is generally spherically shaped, when in a solid state, and, in accordance with the invention, is provided with a lithium component. The lithium provides the amalgam, when liquidized, with the property of wetting the glass tubulation 20 and the glass balls 40. When the liquid amalgam is wetted to the glass, that is, adhered to the glass, the amalgam is prevented from flowing past the glass balls 40 disposed in the tubulation 20 and thereby prevented from entering the lamp envelope 12.

In accordance with an alternative embodiment of the invention, a layer 34 of a metal alloy including a lithium component is coated on an inside surface 26 of the exhaust tubulation 20 (FIG. 3) between the tubulation closed end 24 and the pinched portion 22 of the tubulatlon, that is, in the area of the amalgam body 32. The presence of the lithium alloy layer 34 causes the amalgam, when liquidized, to wet, or adhere, to the lithium alloy layer, preventing the liquid amalgam from flowing past the retaining structure 40 and into the lamp envelope 12.

Figure 3:
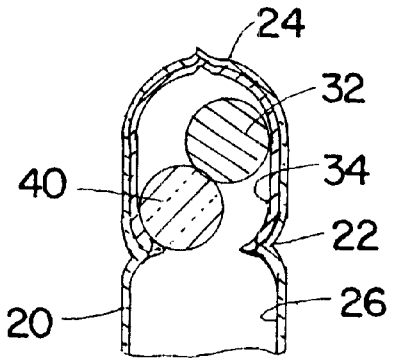
FIG. 3 is similar to FIG. 2 but illustrative of an alternative embodiment.

In the embodiment shown in FIG. 3, the metal layer 34 is adhered to the tubulation inside surface 26 during manufacture of the tubulation. In operation of the lamp 10, the liquid amalgam adheres to the layer 34, to prevent the amalgam from flowing by gravity into the lamp envelope 12.

It will be understood that many additional changes in the details, materials, and arrangement of parts, which have been herein described and illustrated in order to explain the nature of the invention, may be made by those skilled in the art within the principles and scope of the invention as expressed in the appended claims.

What is claimed is:

1. An amalgam assembly for a fluorescent lamp, the assembly comprising:

a glass exhaust tubulation extending from an envelope portion of the lamp toward a base portion of the lamp, said tubulation being closed at an end thereof adjacent the lamp base portion;

a retaining structure disposed in said tubulation and retained by a pinched portion of said tubulation; and a mercury amalgam body disposed in said tubulation between said retaining structure and the tubulation closed end, said amalgam body including lithium for wetting internal surfaces of said glass tubulation to cause said amalgam to adhere to the tubulation internal surfaces when said amalgam body is liquidized and to thereby prevent said amalgam from flowing past said retaining structure and into the lamp envelope.

2. The amalgam assembly in accordance with claim 1 wherein said amalgam body comprises an alloy composition selected from a group of alloy compositions consisting of (i) bismuth and indium and lithium, (ii) bismuth and tin and lead and lithium, (iii) bismuth and tin and lithium, (iv) zinc and indium and tin and lithium, (v) indium and lithium, (vi) lead and lithium, and (vii) zinc and lithium.

3. The amalgam assembly in accordance with claim 1 wherein said retaining structure comprises at least one glass body, and wherein the lithium causes said amalgam to wet the glass body to cause the amalgam to adhere further to the glass body when said amalgam body is liquidized, to further prevent said amalgam from flowing into the lamp envelope.

4. The amalgam assembly in accordance with claim 1 wherein said amalgam body is spherically shaped when in a solid state.

5. An amalgam assembly for a fluorescent lamp, the assembly comprising:

a glass exhaust tubulation extending from an envelope portion of the lamp toward a base portion of the lamp, said tubulation being closed at an end thereof adjacent the lamp base portion;

a mercury amalgam body disposed in said tubulation between the tubulation closed end and a pinched portion of said tubulation; and a layer of metal containing lithium adhered to an inside surface of said exhaust tubulation between the tubulation closed end and the tubulation pinched portion;

wherein upon liquidizing of said amalgam body, the liquid amalgam adheres to said layer, to thereby prevent the amalgam from flowing past the tubulation pinched portion and into the lamp envelope.

6. The amalgam assembly in accordance with claim 5 and further comprising a retaining member disposed in said tubulation between the tubulation pinched portion and said amalgam body.

7. The amalgam assembly in accordance with claim 6 wherein said retaining member comprises a glass body.

8. The amalgam assembly in accordance with claim 7 wherein the glass body is spherically shaped.

9. An electrodeless fluorescent lamp assembly, comprising:

a light-transmissive envelope containing an ionizable, gaseous fill for sustaining an arc discharge when subjected to a radio frequency magnetic field and for emitting ultraviolet radiation as a result thereof, said envelope having an interior phosphor coating for emitting visible radiation when excited by the ultraviolet radiation, said envelope having a re-entrant cavity formed therein;

an excitation coil contained within the re-entrant cavity for providing the radio frequency magnetic field when excited by a radio frequency power supply;

a glass exhaust tubulation extending through the re-entrant cavity and into said envelope, said exhaust tubulation having a closed end proximate a base portion of the lamp;

a pinched configuration formed in said exhaust tubulation at a predetermined distance from the tubulation closed end;

a retaining structure disposed in said tubulation and retained by said pinched configuration; and a mercury amalgam body disposed in said tubulation between said retaining structure and the tubulation closed end, said amalgam body including lithium for wetting internal surfaces of said glass tubulation to cause said amalgam to adhere to the tubulation internal surfaces when said amalgam body is liquidized and to thereby prevent the amalgam from flowing past said retaining structure and into the lamp envelope.

10. The lamp assembly in accordance with claim 9 wherein said amalgam body comprises an alloy composition selected from a group of alloy compositions consisting of (i) bismuth and indium and lithium, (ii) bismuth and tin and lead and lithium, (iii) bismuth and tin and lithium, (iv) zinc and indium and tin and lithium, (v) indium and lithium, (vi) lead and lithium, and (vii) zinc and lithium.

11. The lamp assembly in accordance with claim 9 wherein said retaining structure comprises a glass body, and wherein the lithium is adapted to wet the glass body to cause the amalgam to adhere further to the glass body when said amalgam body is liquidized, to further prevent the amalgam from flowing past the glass body and into the lamp.

12. The lamp assembly in accordance with claim 9 wherein said amalgam body is spherically shaped when in a solid state.

13. The lamp assembly in accordance with claim 9 wherein said retaining structure comprises a glass body.

14. The lamp assembly in accordance with claim 13 wherein the glass body is spherically shaped.

15. An electrodeless fluorescent lamp assembly, comprising:

a light-transmissive envelope containing an ionizable, gaseous fill for sustaining an arc discharge when subjected to a radio frequency magnetic field and for emitting ultraviolet radiation as a result thereof, said envelope having an interior phosphor coating for emitting visible radiation when excited by the ultraviolet radiation, said envelope having a re-entrant cavity formed therein;

an excitation coil contained within the re-entrant cavity for providing the radio frequency magnetic field when excited by a radio frequency power supply;

a glass exhaust tubulation extending through the re-entrant cavity and into said envelope, said exhaust tubulation having a closed end proximate a base portion of the lamp;

a pinched configuration formed in said exhaust tubulation at a predetermined distance from the tubulation closed end;

a retaining structure disposed in said tubulation and retained by said pinched configuration;

a mercury amalgam body disposed in said tubulation between said retaining structure and tubulation closed end; and a layer of metal containing lithium adhered to an inside surface of said exhaust tubulation between the tubulation closed end and said tubulation pinched configuration;

wherein upon liquidizing of said amalgam body, the liquid amalgam adheres to said layer, to thereby prevent the amalgam from flowing past said retaining structure and into the lamp envelope.

16. The lamp assembly in accordance with claim 15 wherein said amalgam body comprises an alloy composition selected from a group of alloy compositions consisting of (i) bismuth and indium and lithium, (ii) bismuth and tin and lead and lithium, (iii) bismuth and tin and lithium, (iv) zinc and indium and tin and lithium, (v) indium and lithium, (vi) lead and lithium, and (vii) zinc and lithium.

17. The lamp assembly in accordance with claim 15 wherein said retaining structure comprises a glass body, and wherein the layer of metal is adapted to wet the glass body to cause the amalgam to adhere further to the glass body when said amalgam body is liquidized, to further prevent the amalgam from flowing into the lamp envelope.

18. The lamp assembly in accordance with claim 17 wherein the glass body is spherically shaped.

* * * * *